US005951315A

United States Patent [19]

Ichimura

[11] Patent Number: 5,951,315

[45] Date of Patent: Sep. 14, 1999

[54] ELECTRICAL CONNECTOR OF A TURN CONTACT TYPE WHICH IS SIMPLE IN SHAPE

[75] Inventor: Yoshiaki Ichimura, Akiruno, Japan

[73] Assignee: Japan Aviation Electronics Industry, Ltd., Tokyo, Japan

[21] Appl. No.: 09/104,516

[22] Filed: Jun. 25, 1998

[51] Int. Cl.[6] ..... H01R 13/62

[52] U.S. Cl. ..... 439/326; 439/67

[58] Field of Search ..... 437/326, 74, 631, 437/638, 67, 77, 495, 329

[56] References Cited

U.S. PATENT DOCUMENTS 5,186,643 2/1993 Bakke et al. ..... 439/326
5,401,182 3/1995 McHugh et al. ..... 439/326
5,458,506 10/1995 Yamaguchi ..... 439/67
5,626,487 5/1997 Cheng et al. ..... 439/326

*Primary Examiner*—Paula Bradley
*Assistant Examiner*—Antoine Hgandjui

[57] ABSTRACT

In an electric connector having a first-side and a second-side contact which are connected to different connection objects, respectively, the first-side contact is of an plate shape and elastically bendable in a thickness direction thereof. The second-side contact has a pair of contact points substantially fixed at predetermined positions which are different from to each other in a first direction. The contact points are directed opposite to each other in a second direction perpendicular to the first direction. The first-side contact is inserted between the contact points and becomes in press contact with the contact points with being elastically bent in the thickness direction.

7 Claims, 3 Drawing Sheets

ELECTRICAL CONNECTOR OF A TURN CONTACT TYPE WHICH IS SIMPLE IN SHAPE

BACKGROUND OF THE INVENTION present invention relates to an electrical connector for use in electrically connecting connection objects such as a printed board, an IC card, and others.

For connecting an IC card to a printed board, use is made of an electrical connector which will be called a turn contact type. A conventional connector of the turn contact type comprises a contact having a terminal portion and a fitting portion which are integral with to each other. The terminal portion is connected to the printed board. The fitting portion is loosely inserted with the IC card. When operation force is applied to the IC card in a thickness direction thereof, the IC card turns to become in press contact with the fitting portion with an elastic deformation of the fitting portion. Therefore, the IC card is electrically connected to the printed board through the connector. Such a connector will often be called hereinafter a turn contact type connector.

As will later be described in conjunction with the drawing, the conventional connector has a problem in which the contact is complicated and difficult to reduce a thickness and a size thereof. This results in difficulty of manufacturing the contact. Specifically, for achieving a reliable contact, it is necessary to set contact forces of the contact relative to the IC card be great. In this case, however, the large moment is applied to the contact. Accordingly, the contact should have a strength large enough to bear such a large moment. Further, for ensuring the sufficient deformation capability, the fitting portion of the contact is required to be large in size and complicated in shape.

SUMMARY OF THE INVENTION

It is therefore an object of the present invention to provide a turn contact type connector which is simple in shape and easy to manufacture, and can be small in thickness and size.

Other objects of the present invention will become clear as the description proceeds.

According to one aspect of the present invention, there is provided an electric connector comprising a first-side contact for being connected to a first connection object. The first-side contact is of a plate shape and elastically bendable in a thickness direction thereof. The electric connector further comprises a second-side contact for being connected to a second connection object. The second-side contact has a pair of contact points substantially fixed at predetermined positions which are different from to each other in a first direction. The contact points are directed opposite to each other in a second direction perpendicular to the first direction. The first-side contact is inserted between the contact points and become in press contact with the contact points with being elastically bent in the thickness direction.

DESCRIPTION OF THE PREFERRED EMBODIMENT

Figure 1:
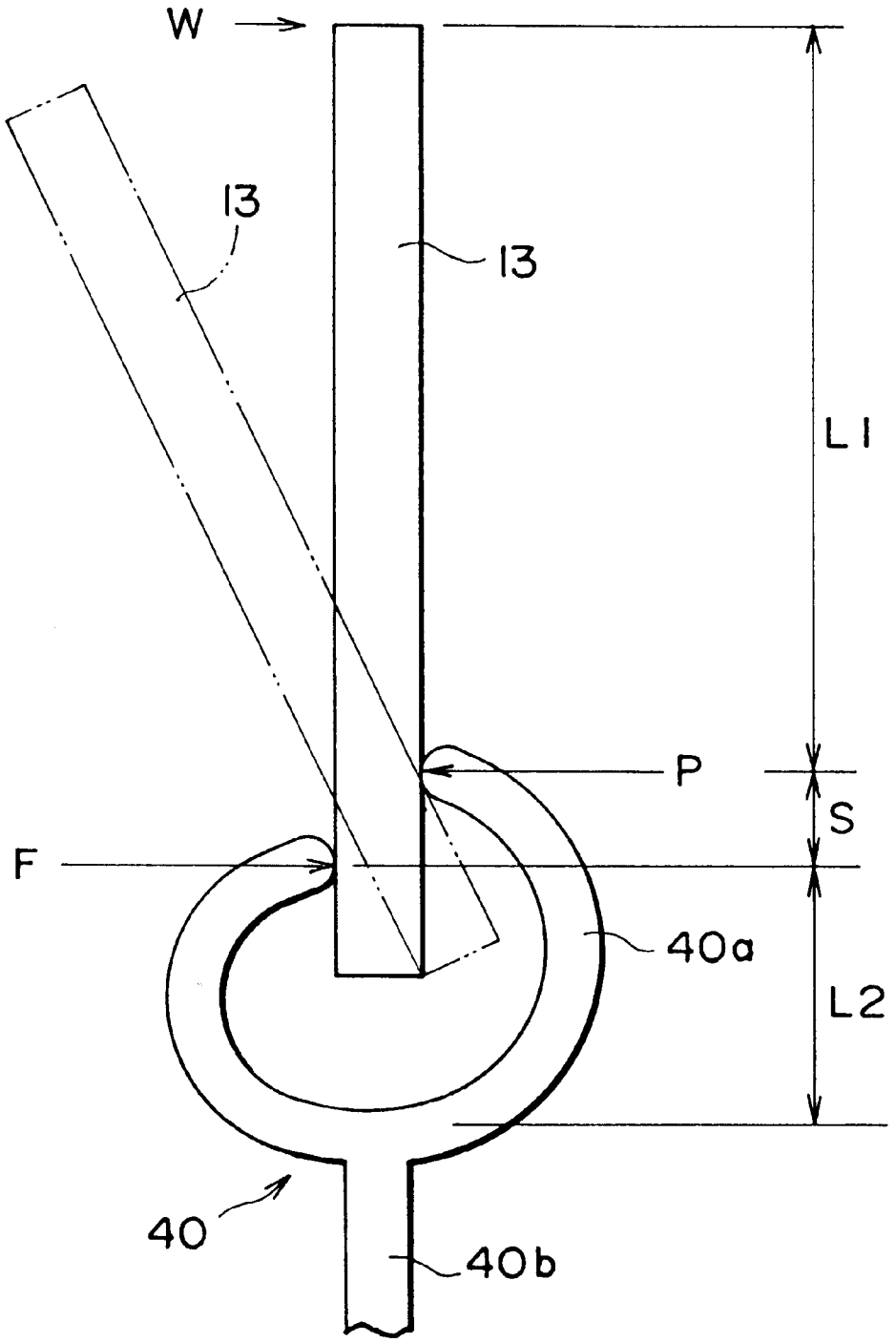
FIG. 1 PRIOR ART
FIG. 1 is an explanatory diagram of a conventional turn contact type connector.

Referring to FIG. 1, description will be made at first as regards a conventional turn contact type connector for better understanding of the present invention.

The conventional turn contact type connector comprises a contact 40 made of a conductive material. The contact 40 has a fitting portion 40*a* and a terminal portion 40*b* which are integral with to each other. The terminal portion 40*b* is connected to a first printed board (not shown). The fitting portion 40*a* is loosely inserted at first with a second printed board 13, such as IC card known in the art, in an inclined posture or attitude as shown by a chain double-dashed line. When operation force W is applied to the second printed board 13 in a thickness direction thereof, the second printed board 13 turns to become in press contact with the fitting portion 40*a* at tow points with an elastic deformation of the fitting portion 40*a*. Therefore, the second printed board 13 is electrically connected to the first printed board through the connector 40.

In the connector, due to the principle of the lever, sufficient contact forces P and F can be obtained by the operation force W that is relatively small. Specifically, since $$W\cdot(L1+S)=P\cdot S$$

and $$W\cdot L1=F\cdot S$$

due to the equilibrium condition of the moment, $$W=(S/L1+S)\cdot P=(S/L1)\cdot F.$$

Therefore, when L1 is much greater than S, W becomes much smaller than P and F.

Figure 2:
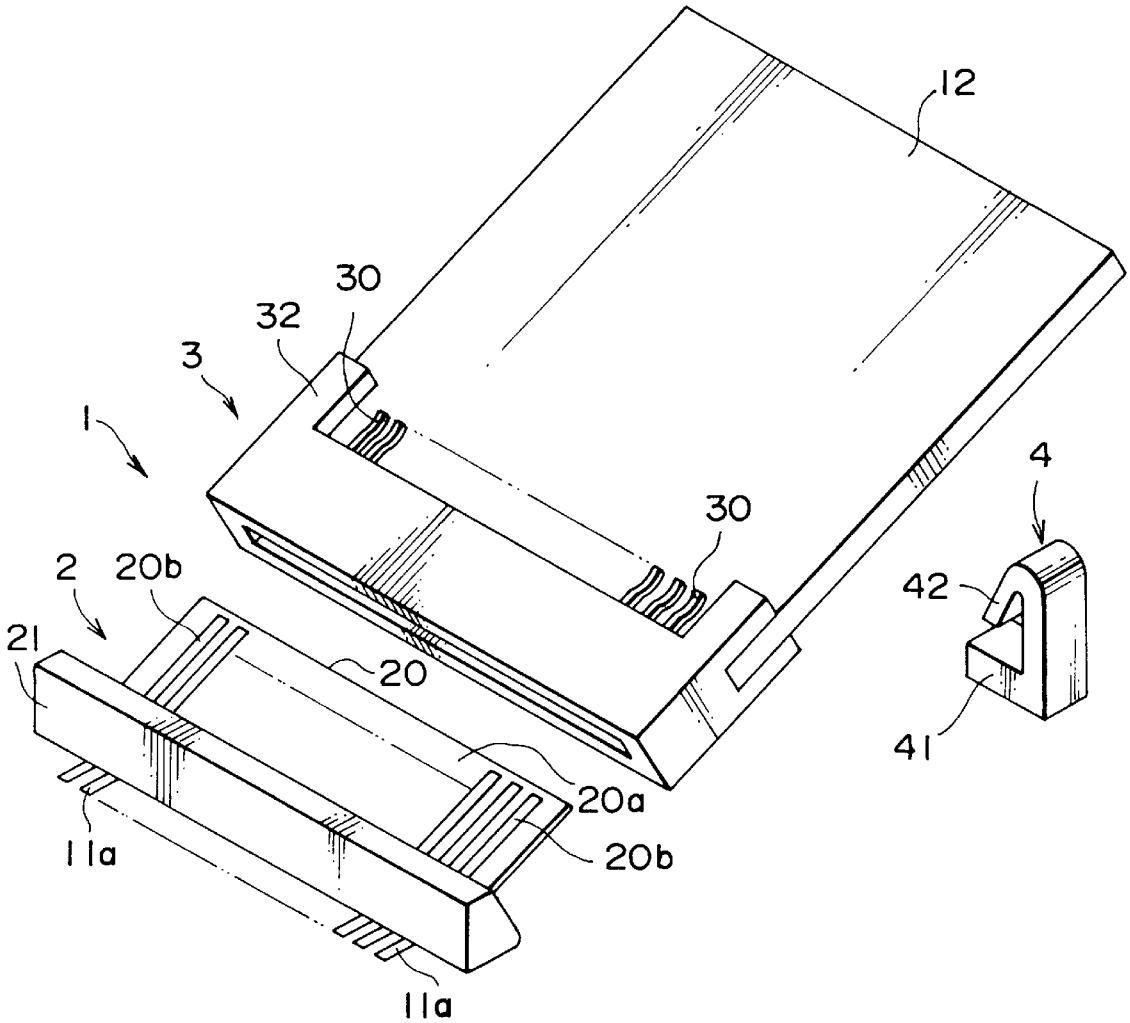
FIG. 2 is a perspective view of a turn contact type connector in a detached or released state according to a preferred embodiment of the present invention.

Referring to FIG. 2, the description will be made as regards a turn contact type connector according to a preferred embodiment of the present invention. The connector is designated by a reference numeral 1 and is for connecting a printed board 11 as a first connection object and an IC card 12 as a second connection object to each other. The connector 1 comprises a first-side connector 2, a second-side connector 3 and a retaining member 4. As the first or second connection object, a plate-like member similar to the printed board or the IC card may also be used.

The first-side connector 2 is fixed to the printed board 11, while the second-side connector 3 is fixed to the IC card 12. The first-side connector 2 and the second-side connector 3 are attached or connected to each other by turning one of the printed board 11 and the IC card 12, for example, the IC card 12, from the state of FIG. 3 to the state of FIG. 4.

Figure 3:
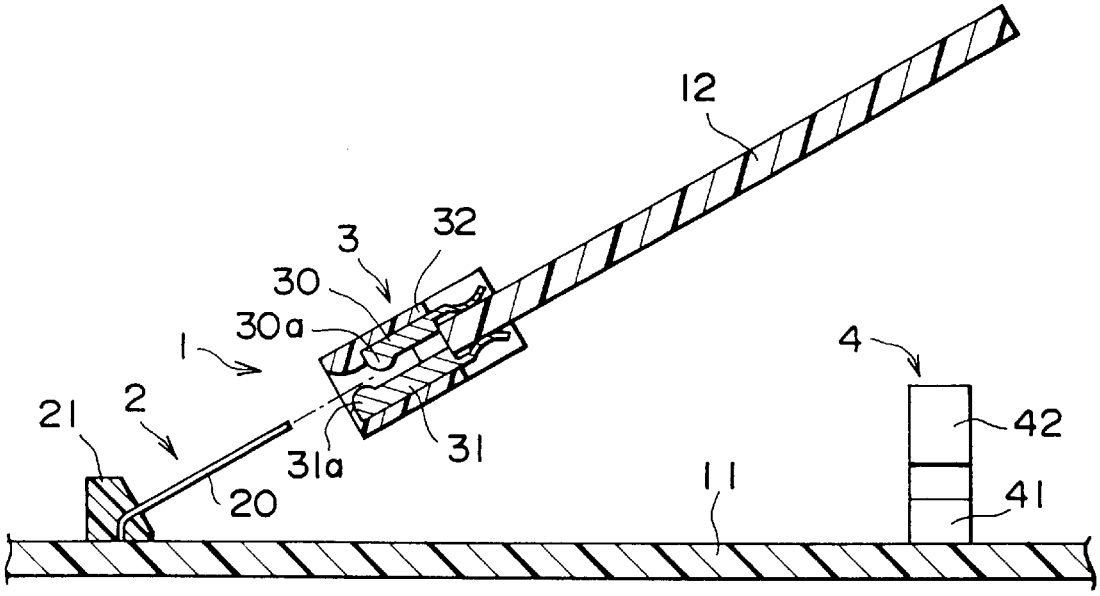
FIG. 3 is an explanatory diagram showing a state of the connector of FIG. 2 just before attaching or fitting, wherein components of the connector are fixedly mounted to a printed board and an IC card.
Figure 4:
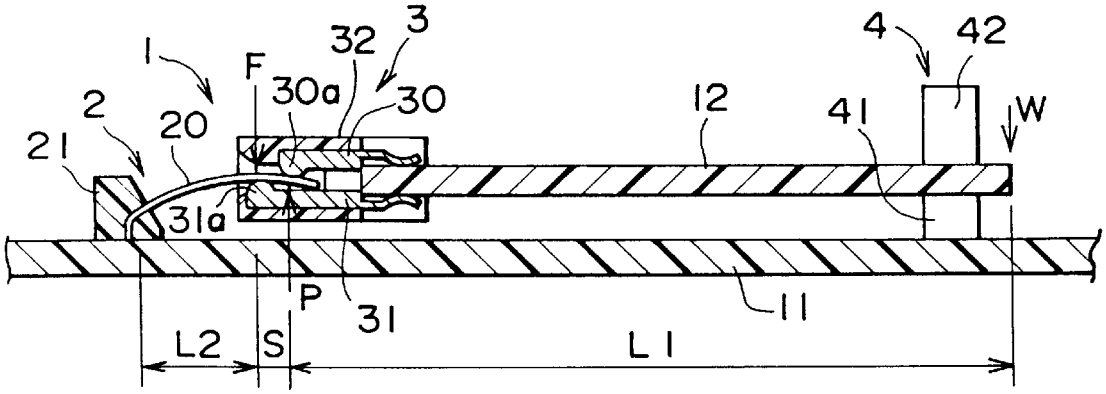
FIG. 4 is an explanatory diagram showing a state of the connector of FIG. 2 being attached or fitted, wherein the components of the connector are fixedly mounted to the printed board and the IC card.

The retaining member 4 comprises a mounting portion 41 and a retaining piece 42 which are integral with to each other. For holding the connection state between the first-side connector 2 and the second-side connector 3, the retaining member 4 is fixed to one of the printed board 11 and the IC card 12, for example, the printed board 11 as shown in FIGS. 2 and 3 by bonding or screwing the mounting portion 41 thereof to the printed board 11. In the state of FIG. 4, a rear end (a right end in the figure) of the IC card 12 is retained by the retaining piece 42 of the retaining member 4.

The first-side connector 2 comprises a first-side contact 20 and an insulator housing 21. The first-side contact 20 is in the form of an elastic plate and comprises a contact body 20*a* made of an insulating film and a plurality of contact portions 20*b* made of elastic metal thin plates. The insulating film has a first principal surface or front side and a second principal surface or reverse side. The contact portions 20*b* are bonded to the front and the reverse sides of the contact body 20*a*. The contact portions 20*b* will be referred to as a first and a second metal plate which are attached to the front and the reverse sides of the contact body 20*a*, respectively.

Further, the first-side contact 20 is fixed at one end thereof to the printed board 11 by means of the housing 21 so that the contact portions 20*b* are connected to conductor patterns 11*a* of the printed board 11.

The second-side connector 3 is fixed to the IC card 12. The second-side connector 3 comprises second-side contacts 30 and 31 engageable with the first-side contact 20 and an insulator housing 32. Each of the second-side contacts 30 and 31 has rigidity and allowed to receive therebetween the other end of the first-side contact 20 in a given direction so as to sandwich it in a non-contact state. The second-side contacts 30 and 31 confront a front and a reverse side of the first-side contact 20. Each of the second-side contacts 30 and 31 has a pair of contact points 30*a* and 31*a* which are offset in position from each other in a first direction or the foregoing given direction. The contact points 30*a* and 31*a* are directed opposite to each other in a second direction perpendicular to the first direction. Inasmuch as the second-side contact has rigidity, the contact points 30*a* and 31*a* are substantially fixed at predetermined positions which are different from each other in the first direction. In other words, the contact points 30*a* and 31*a* are substantially prevented from being displaced from the predetermined positions.

The second-side contacts 30 and 31 are provided in the housing 32 so as to correspond to the contact portions 20*b* of the first-side contact 20, respectively. It is preferable that the housing 32 holds the contact points 30*a* and 31*a* to prevent from being displaced from the predetermined positions.

Referring to FIGS. 3 and 4, in the turn contact type connector 1, the first-side contact 20 abuts the contact points 30*a* and 31*a* under pressure by turning one of the printed board 11 and the IC card 12, for example, the IC card 12, so as to elastically deform the first-side contact 20 in a thickness direction thereof.

Specifically, in FIG. 3, the second-side connector 3 fixed to the IC card 12 is moved to receive the first-side contact 20 of the first-side connector 2 between the second-side contacts 30 and 31 along the foregoing given direction. In this event, since no contact forces are applied between the first-side contact 20 and the second-side contacts 30 and 31, the first-side contact 20 can be inserted with no resistance or only a small resistance. After the insertion, by applying an operation force W to the rear end of the IC card 12, the second-side connector 3 turns along with the IC card 12.

Then, in the state of FIG. 4 where the turn is finished, contact forces P and F are applied to contact portions between the first-side connector 2 and the second-side connector 3 so that connection between the first-side contact 20 and the second-side contacts 30 and 31 is achieved. As described above, the rear end of the IC card 12 is retained by the retaining piece 42 of the retaining member 4 so that the state of FIG. 4 is held. In other words, the retaining member 4 cooperates with the printed board 11 and the IC card 12 to retain a state where the first-side contact 20 is elastically bent in a thickness direction thereof. Similar to the foregoing prior art, by setting L1 to be much greater than S in FIG. 4, the operation force W can be rendered very small.

The turn contact type connector 1 can be easily manufactured with a simple shape. Further, the moment applied to the contact is small. Specifically, in FIG. 4, although the forces P and F are applied to the first-side contact 20, when L1 is much greater than S, the moment approximately equal to a couple (P·S) is applied in a section L2 in the figure of the first-side contact 20 since P and F are approximately equal to each other. This moment is much smaller as compared with $$F \cdot L2$$

and $$P \cdot (L2+S)$$

in the foregoing prior art. Since the moment applied to the contact is small as explained above, stresses exerted on a material of the contact are rendered small so that the reduction in thickness and size can be promoted as compared with the prior art.

Further, the elastic metal plates forming the contact portions can be easily bonded to the front and reverse sides of the insulating film, and a laminated structure can be easily obtained. Further, by arranging the contact portions on the front and reverse sides to be independent of each other, the mounting density of the contact portions can be essentially doubled. Further, by grounding the contact portions on one of the front and reverse sides of the insulating film to provide a microstripline structure, impedance matching can be easily achieved to provide a connector excellent in high-speed transmission characteristic.

While the present invention has been described in terms of the preferred embodiment, the invention is not to be limited thereto, but can be embodied in various ways without departing from the principle of the invention as defined in the appended claims.

What is claimed is:

1. An electric connector comprising:

a first-side contact for being connected to a first connection object, said first-side contact being of a plate shape and elastically bendable in a thickness direction thereof;

a second-side contact for being connected to a second connection object, said second-side contact having a pair of contact points substantially fixed at predetermined positions which are different from to each other in a first direction, said contact points being directed opposite to each other in a second direction perpendicular to said first direction;

said first-side contact being inserted between said contact points and becoming in press contact with said contact points with being elastically bent in said thickness direction.

2. An electric connector as claimed in claim 1, wherein said second-side contact has rigidity to substantially prevent said contact points from being displaced from said predetermined positions.

3. An electric connector as claimed in claim 1, further comprising a housing which holds said second-side contact to prevent said contact points from being displaced from said predetermined positions.

4. An electric connector as claimed in claim 1, further comprising a housing which holds said first-side contact to allow an elastic bent of said first-side contact.

5. An electric connector as claimed in claim 1, further comprising retaining means cooperated with said first and said second connection objects for retaining a state where said first-side contact is elastically bent in said thickness direction.

6. An electric connector as claimed in claim 1, wherein said first-side contact comprises:

an insulating film having a first and second principal surfaces opposite to each other; and a first metal plate attached to said first principal surface for becoming in contact with one of said contact points; and a second metal plate attached to said second principal surface for becoming in contact with another of said contact points.

7. An electric connector as claimed in claim 6, wherein said second-side contact comprises:

a first metal member having one of said contact points; and a second metal member having another of said contact points and being insulated from said first metal member.

* * * * *